United States Patent [19]

Carlson

[11] 3,934,554

[45] Jan. 27, 1976

[54] WATER AND ROOM HEATER

[76] Inventor: Philip E. Carlson, 917 Maple St., Prentice, Wis. 54556

[22] Filed: June 3, 1974

[21] Appl. No.: 475,610

[52] U.S. Cl. ..... 122/176; 122/264; 122/367 C; 126/101; 126/362

[51] Int. Cl.[2] ..... F22B 7/06

[58] Field of Search ..... 126/101, 361, 362; 122/176, 264, 367 C; 237/16, 18; 431/157

[56] References Cited

UNITED STATES PATENTS

| | | | |
|---|---|---|---|
| 667,326 | 2/1901 | Leightham | 122/176 |
| 878,356 | 2/1908 | Coppridge | 122/264 |
| 1,089,551 | 3/1914 | Hard | 122/264 |
| 1,528,845 | 3/1925 | Patterson | 122/176 |
| 1,794,801 | 3/1931 | Souter | 122/166 R |
| 3,190,340 | 6/1965 | Fritsch | 431/157 |
| 3,329,131 | 7/1967 | Wright | 431/157 |
| 3,388,692 | 6/1968 | Hale | 122/367 C |
| 3,404,674 | 10/1968 | Albert | 126/101 |

*Primary Examiner*—Kenneth W. Sprague
*Assistant Examiner*—Larry I. Schwartz
*Attorney, Agent, or Firm*—Jacobson and Johnson

[57] ABSTRACT

A water and room heating unit for extracting heat from combustible material. The heating unit includes a firebox chamber formed from a plurality of water chambers that are arranged in a U-shape and are interconnected by a first network of pipes which also function as grates and a second network of heat extracting pipes having radial fins projecting therefrom. The firebox includes an air combustion control and a flue for extracting heat from the combusted gases to heat the surrounding atmosphere.

2 Claims, 4 Drawing Figures

FIG. 1
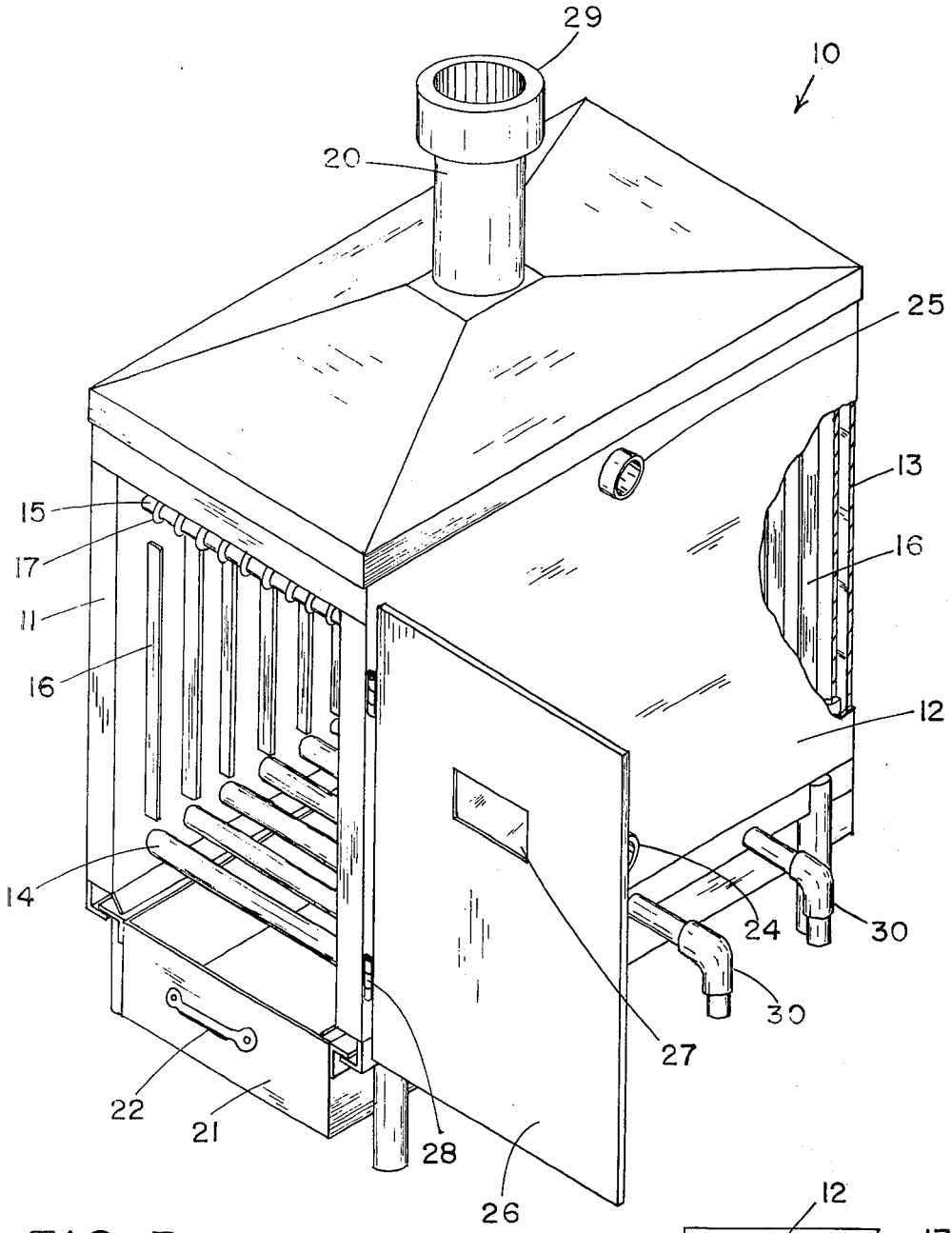
FIG. 3
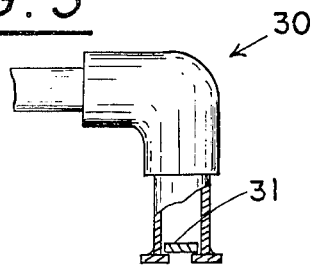
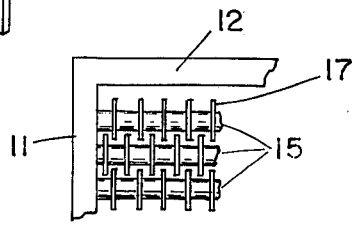
FIG. 2

WATER AND ROOM HEATER

BACKGROUND OF THE INVENTION

1. Field of the Invention

This invention relates generally to heating unit combustion chambers and, more specifically, to a combustion chamber for extracting heat from combustible materials to heat water and the surrounding atmosphere.

2. Description of the Prior Art

The concept of utilizing a fire chamber having water pipes running through the fire chamber to heat water is old in the art. The present invention comprises an improvement to these types of water heaters to provide a more efficient and effective way for extracting the heat from the combustion chamber and for also extracting the heat from the combusted gases to heat the surrounding atmosphere. Thus, the present invention provides not only a unit for heating water and the like but a unit for heating the surrounding atmosphere. That is, the present invention has its ideal application for cabins, basements and the like in which an intermittent amount of heat is required. The unit comprises a firebox chamber which has two networks of pipes and three water jackets surrounding the fire chamber and a flue chamber for extracting heat from the combusted gases to heat the surrounding atmosphere.

BRIEF SUMMARY OF THE INVENTION

Briefly, the invention comprises a heating unit having side walls comprised of three interconnected water jackets which are formed into a U-shape. A first network of pipes connect the bottoms of two of the water jackets to one another and also functions as a set of grates. A second network of pipes having radial fins projecting therefrom and alternately spaced therein connect the tops of two of the water jackets to one another. Located on the flue pipe of the combustion chamber is a heat extractor for removing heat from the flue gases to heat the surrounding atmosphere. The heating unit further includes means for providing combustion air to the combustion chamber and means for controlling the amount of combustion air entering the combustion chamber.

BRIEF DESCRIPTION OF THE DRAWING

FIG. 1 is a pictorial view of my heating unit with the front door open;

FIG. 2 is a sectional view revealing the alternate spacing of fins on the heat extractor pipes;

FIG. 3 is a partial sectional view of the air inlet; and

DESCRIPTION OF THE PREFERRED EMBODIMENT

Figure 4:
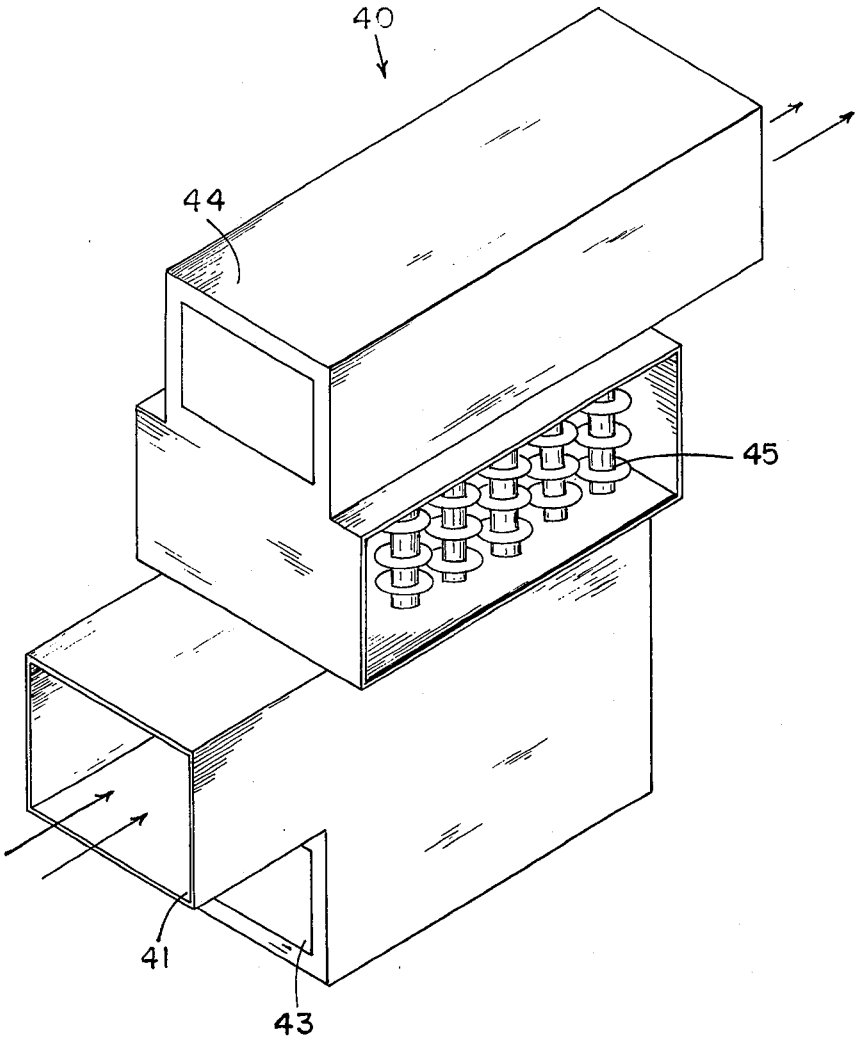
FIG. 4 is a pictorial view of the flue gas heat extractor.

Referring to FIG. 1, reference numeral 10 generally designates my heating unit with door 26 open. The water heater comprises a first side chamber or water jacket 11, a second side chamber or water jacket 12 which is connected to the first chamber by a back chamber or water jacket 13. These three chambers are arranged to form U-shaped, vertical walls of the firebox. Projecting vertically outward from the metal water jackets 11, 12 and 13 are a plurality of vertical spaced ribs 16 which conduct the heat from the firebox chamber to the water located in the water jackets 11, 12 and 13. Typically, the ribs 16 project approximately 1 inch from the water jacket which is made of 3/16 inch boiler plate. In the preferred embodiment, the ribs are welded to the water jacket and spaced at approximately 2 inch intervals.

Located at the bottom portion of the firebox is a plurality of grates which is a network of water pipes that connect first side chamber 11 to second side chamber 12. The grates perform a dual function as they act as a fire bed as well as transferring heat to the water contained in the pipes. Similarly, located at the top of firebox 10 is a plurality of heat extractor pipes 15 having spaced, circular heat conducting fins 17 located thereon. The heat extractor pipes 15 comprise a network of pipes that are spaced parallel to one another from the front of the firebox to the back of the firebox. This network of heat extractor pipes connects the first side chamber to the second side chamber. Located on each of the heat extractor pipes are annular radial fins 17 which are approximately 3 inch diameter and parallel spaced along the 1 inch diameter heat extractor pipes. In the preferred embodiment the fins are welded to the heat extractor pipes and are spaced so that the fins project into the region between fins on adjacent heat extractor pipes as shown in FIG. 2.

Located at the top of firebox 10 is a smoke outlet 20 for discharging the combusted gases and an exhaust fan 29. Located at the bottom of firebox 10 is an ash drawer 21 which has a handle 22 thereon for sliding out to remove ashes, etc. and the material that falls through the grates and into ash drawer 21.

A door 26 is hingedly mounted to water jacket 12 by hinges 28. Door 26 is provided with a glass section 27 to allow one to look inside the firebox without opening door 26. When door 26 is closed the approximate inside dimensions of my firebox are vertical 20 inch, horizontal 16 inch and depth 30 inch.

Located in the side of second chamber 10 is a lower cold water inlet 24 and a higher hot water outlet 25. Similarly, a cold water inlet and hot water outlet can be located on first side chamber 11 or back chamber 13. Spaced along the side of firebox 10 are combustion air inlet control devices 30. In the preferred embodiment I utilize three air inlet devices on each side and one in front and one in back, however, more or less units could be used depending on the amount of entering air required. Reference to the cross-sectional view of FIG. 3 shows the details of air inlet device 30 to comprise a gravity held flapper valve 31 which can be pulled upward by creating a lower pressure in firebox 10. To control the amount of air entering the firebox, an exhaust fan 29 is connected to the smoke collector and outlet 20 to lower the pressure in firebox 10. Lowering the pressure in the firebox will open the flappers and allow more fresh air or oxygen into the firebox chamber. Conversely, lowering the pressure will close the flappers and allow less oxygen into the firebox. In the preferred embodiment, the exhaust fan 29 is connected to a thermostat so that a greater or lesser pressure will be created in the firebox according to the temperature of the water in the water jackets.

Referring to FIG. 4, reference numeral 40 generally designates my flue gas heat extractor which comprises a flue gas inlet 41 that is connected by suitable pipes to firebox vent 20. Located below inlet 41 is an ash drawer 43 that slides out for easy removal of flue ash. After the hot flue gases enter inlet 41, the flue gas passes through a parallel network of pipes 45 which have radial fins projecting therefrom. As the pipes and fins are identical to pipes 15, they will not be described in detail. After passing through the network of pipes 45, the flue gases enter a plenum chamber 44 where they are exhausted to outside of the building. The purpose of using a set or network of smaller pipes with fins thereon is to capture some of the heat in the hot flue gases and use it to heat the room. Thus, it is envisioned that my heating unit comprises both a room heater and a water heater. As a water heater, the unit heats the water or liquid within the firebox network of pipes and water jackets and any excess heat is radiated to the room. In addition, a portion of the heat in the flue gases are recovered and circulated in the room through the use of the vertically extending heat extractor located in the flue. In the preferred embodiment I utilize twenty-one 1¼ inch vertical heat extractor pipes which is equivalent to slightly over 6 inch round vent pipe.

I claim:

1. An improved water heater and room heater for more efficiently utilizing the combustion heat of cumbustible materials and the like comprising a firebox having a top and a bottom, said firebox including a first metal water chamber, a second metal water chamber, and a third metal water chamber arranged to form U-shaped, vertical walls, said first water chamber, said second water chamber and said third water chamber each having a plurality of solid, metal, elongated, vertically spaced ribs projecting therefrom and into the firebox for thereby transmitting the heat from the combustion of materials in the firebox to the water located in said first water chamber, said second water chamber and said third water chamber; a plurality of metal grates for supporting the combustible material, said plurality of metal grates connecting said first water chamber to said second water chamber, said plurality of grates providing a first network for passage of water from said first water chamber to said second water chamber, and for extracting heat from the combustion of materials in said firebox; a plurality of heat extracting members located at the top of the firebox, said heat extracting members including a plurality of metal heat extracting pipes having a plurality of radial projecting fins located thereon, said radial fins alternately spaced on said metal heat extracting pipes, said plurality of heat extracting pipes thereby providing a second network for passage of water between said first water chamber and said second water chamber, said plurality of radial projecting fins coacting with said heat extracting pipes to more efficiently extract heat from the combustion of materials in said firebox; said first water chamber, said second water chamber, said third water chamber, said network of grates and said network of heat extracting pipes thereby coacting to provide a firebox that is operable for receiving the heat of combustion from the combustible material from at least five different sides, a cold water inlet located at the bottom of said water chamber and a hot water outlet located at the top of said water chamber, said firebox further including means for receiving the combustion ash, means for allowing the entrance of combustion air, means for controlling the amount of combustion air to the firebox chamber, and means for discharging the combusted gases.

2. The invention of claim 1 wherein said means for the discharge of combusted gas includes a network of flue pipes having radial fins projecting therefrom for radiating a portion of the heat from the combustion gases to the surrounding atmosphere, said radial fins alternately spaced on said network of flue pipes.

* * * * *